US005454016A

United States Patent [19]

Holmes

[11] Patent Number: 5,454,016

[45] **Date of Patent: * Sep. 26, 1995**

[54] METHOD AND APPARATUS FOR DETECTING AND COUNTING ARTICLES

[75] Inventor: David J. Holmes, Annapolis, Md.

[73] Assignee: Batching Systems Inc., Owings, Md.

[ * ] Notice: The portion of the term of this patent subsequent to May 17, 2011 has been disclaimed.

[21] Appl. No.: 238,861

[22] Filed: May 6, 1994

Related U.S. Application Data

[63] Continuation-in-part of Ser. No. 812,010, Dec. 23, 1991, Pat. No. 5,313,508.

[51] Int. Cl.[6] ..... G06M 7/00

[52] U.S. Cl. ..... 377/6; 377/53; 377/206.1; 377/221

[58] Field of Search ..... 377/6, 53; 250/226, 250/221, 206.1

[56] References Cited

U.S. PATENT DOCUMENTS

| | | | |
|---|---|---|---|
| 3,618,819 | 11/1971 | Blackburn | 377/6 |
| 3,692,980 | 9/1972 | Getker et al. | 377/6 |
| 4,127,766 | 11/1978 | Thayer | 377/6 |
| 4,364,035 | 12/1982 | Kirsch | 250/226 |
| 4,628,520 | 12/1986 | Menger | 377/6 |
| 4,675,520 | 6/1987 | Harrsen et al. | 250/221 |
| 4,782,500 | 11/1988 | Lyngsie | 377/6 |
| 4,982,412 | 1/1991 | Gross | 377/6 |
| 5,313,508 | 5/1994 | Ditman et al. | 377/6 |

*Primary Examiner*—John S. Heyman
*Attorney, Agent, or Firm*—Nies, Kurz, Bergert & Tamburro

[57] ABSTRACT

A method and apparatus for counting irregularly-shaped articles. A pair of light sources are provided at a sensing plane through which articles to be counted are adapted to pass. Each of the light sources emits a light beam that is at an angle to the other light beam, such as an angle of about 90°. Corresponding solar cells are positioned opposite the respective light sources to receive the light signals as the articles pass through the sensing plane. The light sources are alternately operated and the outputs from the respective light detectors are used to calculate an equivalent volume for the article for comparison with a predetermined article volume range to decide whether to count the article. The method and apparatus permit accurate counts of irregularly shaped articles and are substantially independent of the orientation of the article at the sensing plane.

8 Claims, 9 Drawing Sheets

72L5240
72L5240
VCC
74L5138
VCC
CON20
VCC
74L-
5138
VCC
74L5138
VCC
70
CELL 1
MC34074
A/D
CONV.
+12V
+12V
+12V
ADC0820
+12V
+12V
74
AD7528
VCC
72
CELL 2
A/D
CONV.
+12V
+12V
+12V
ADC0820
+12V
+12V
76
AD7528

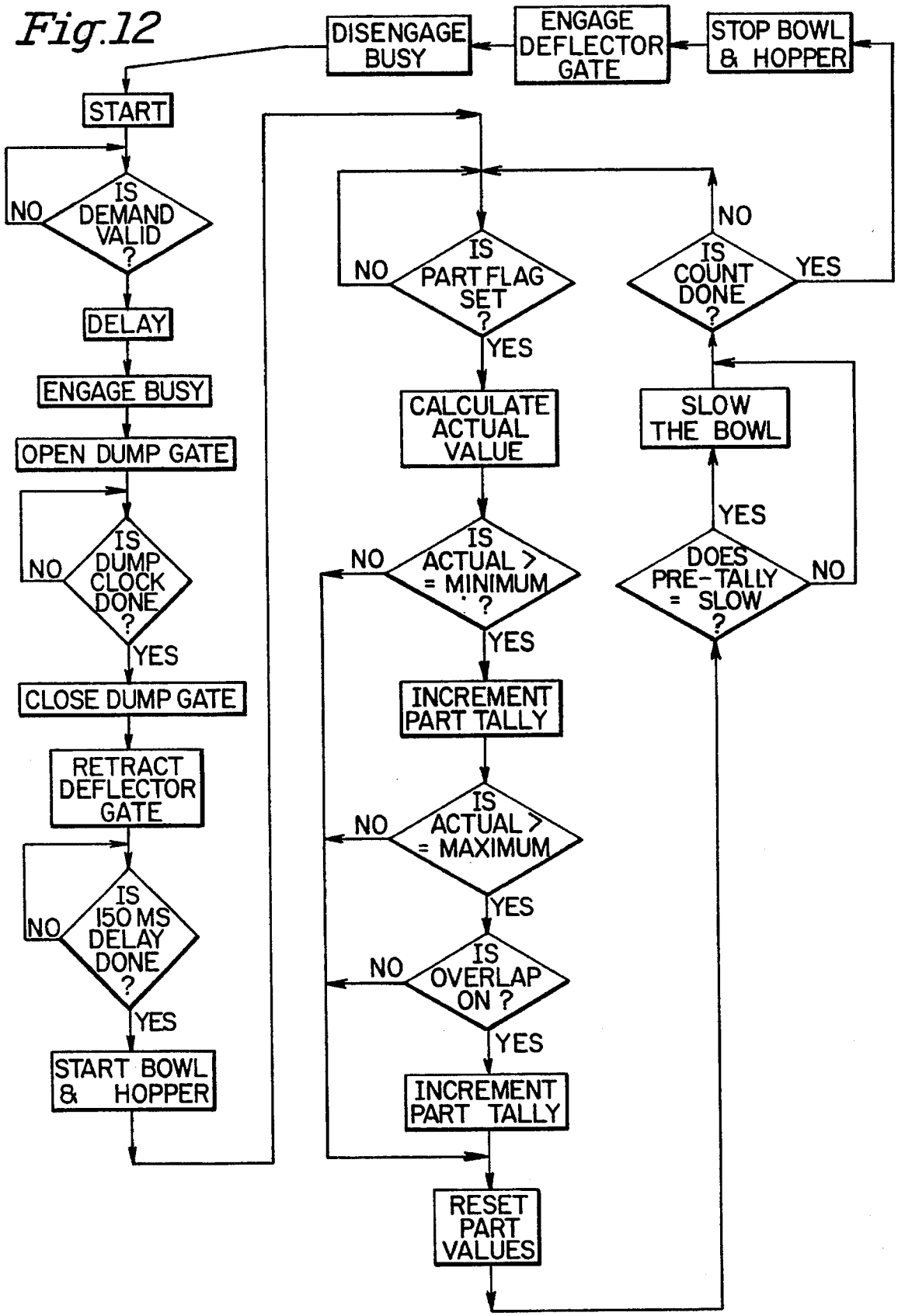
Fig.12
START
IS DEMAND VALID ?
NO
DELAY
ENGAGE BUSY
OPEN DUMP GATE
IS DUMP CLOCK DONE ?
NO
YES
CLOSE DUMP GATE
RETRACT DEFLECTOR GATE
IS 150 MS DELAY DONE ?
NO
YES
START BOWL & HOPPER
DISENGAGE BUSY
ENGAGE DEFLECTOR GATE
STOP BOWL & HOPPER
IS PART FLAG SET ?
NO
YES
CALCULATE ACTUAL VALUE
IS ACTUAL > = MINIMUM ?
NO
YES
INCREMENT PART TALLY
IS ACTUAL > = MAXIMUM
NO
YES
IS OVERLAP ON ?
NO
YES
INCREMENT PART TALLY
RESET PART VALUES
IS COUNT DONE ?
NO
YES
SLOW THE BOWL
DOES PRE-TALLY = SLOW ?
YES
NO

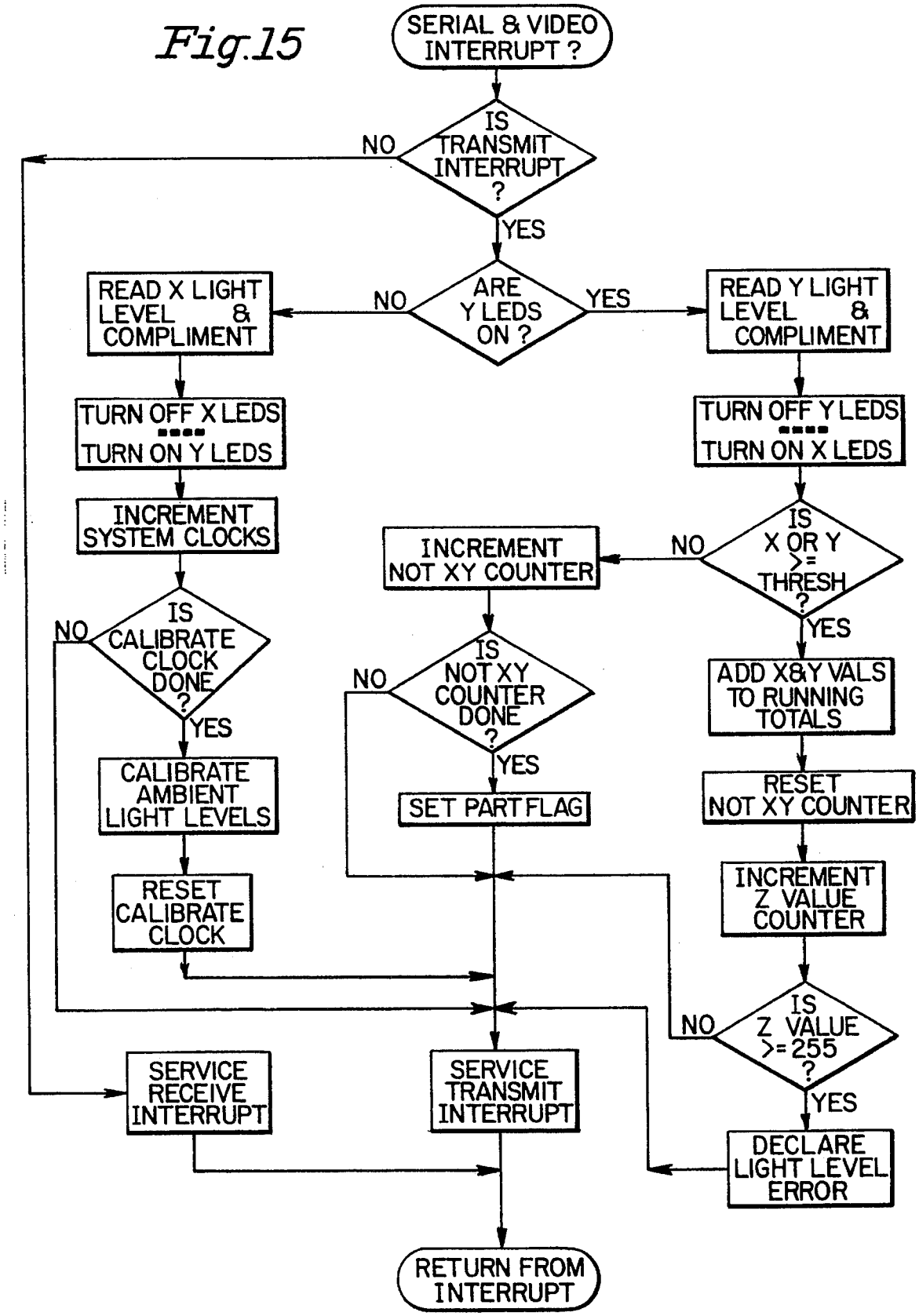
Fig.15
SERIAL & VIDEO INTERRUPT ?
IS TRANSMIT INTERRUPT ?
NO
YES
ARE Y LEDS ON ?
NO
YES
READ X LIGHT LEVEL & COMPLIMENT
READ Y LIGHT LEVEL & COMPLIMENT
TURN OFF X LEDS
TURN ON Y LEDS
TURN OFF Y LEDS
TURN ON X LEDS
INCREMENT SYSTEM CLOCKS
IS X OR Y >= THRESH ?
NO
YES
INCREMENT NOT XY COUNTER
IS CALIBRATE CLOCK DONE ?
NO
YES
IS NOT XY COUNTER DONE ?
NO
YES
ADD X&Y VALS TO RUNNING TOTALS
CALIBRATE AMBIENT LIGHT LEVELS
SET PART FLAG
RESET NOT XY COUNTER
RESET CALIBRATE CLOCK
INCREMENT Z VALUE COUNTER
IS Z VALUE >= 255 ?
NO
YES
SERVICE RECEIVE INTERRUPT
SERVICE TRANSMIT INTERRUPT
DECLARE LIGHT LEVEL ERROR
RETURN FROM INTERRUPT

METHOD AND APPARATUS FOR DETECTING AND COUNTING ARTICLES

CROSS-REFERENCE TO RELATED APPLICATION

This application is a continuation-in-part of application Ser. No. 07/812,010, filed Dec. 23, 1991, now U.S. Pat. No. 5,313,508.

BACKGROUND OF THE INVENTION

1. Field of the Invention

The present invention relates to a method of and an apparatus for detecting and counting articles as they are carried along or allowed to fall through a passageway across which a light beam extends and through which the articles are constrained to pass. More particularly, the present invention is directed to a method of and an apparatus for detecting articles by providing a pair of crossed light beams at a sensing plane in the passageway, to permit the detection of articles that pass through the crossed light beams, wherein the detection is independent of the orientation of the articles relative to the respective light sources, and for accurately counting the articles regardless of their shape and their orientation relative to the respective light beams.

2. Description of the Related Art

Devices for detecting and counting articles are broadly known. For example, in U.S. Pat. No. 3,618,819, which issued Nov. 9, 1971, to Charles M. Blackburn and John L. Ditman there is disclosed an electronic counting apparatus wherein the interruption of a single, thin, narrow beam of light that extends across the passageway through which articles pass is sensed by a solar cell positioned opposite the source of the light beam. The length of the output pulse from the solar cell is utilized to determine that an article has passed the sensing plane.

In U.S. Pat. No. 4,982,412, which issued Jan. 1, 1991, to Barry M. Gross, there is disclosed an apparatus and a method for counting a plurality of similar articles. That patent discloses a counter in the form of a light source and a photoelectric cell, the cell sensing interruption of the light beam. The device provides an output when the light sensor output falls below a predetermined level. The device is so configured that a predetermined time interval can be set for the duration of the detector output signal, in order to avoid overcounting.

In U.S. Pat. No. 4,675,520, which issued Jun. 23, 1987, to Jan Harrsen et al., there is disclosed a counter for counting small particles, such as seeds, by providing crossing light beams that are operated in synchronization in sequential scanning cycles to provide pulses in two perpendicular directions, the pulses being multiplied together to provide a unitary output signal indicative of the presence of a particle to be counted.

Although the prior art has disclosed the provision of arrangements for detecting and counting articles that pass through a light beam defining a sensing plane, and thereby interrupt the beams of light as a result of the passage of the articles, most of the prior art devices are directed to sensing symmetrical objects that provide similar detector outputs in each of two different directions.

It is an object of the present invention to overcome the deficiencies of the prior art devices and to provide an article detecting and counting method and apparatus for accurately counting non-symmetrical articles.

It is another object of the present invention to provide an article detecting and counting apparatus that is relatively simple and inexpensive to manufacture and to maintain, and that is both accurate and reliable.

SUMMARY OF THE INVENTION

Briefly stated, in accordance with one aspect of the present invention, a method of detecting and counting articles is provided. The articles travel along or fall through a passageway, and a pair of light sources are positioned at one point in the passageways and are oriented to provide crossing light beams that extend across the passageway. A pair of light detectors is so positioned opposite respective ones of the light sources so that the light from each light source is received by only one of the detectors. Each detector provides an individual output signal that is representative of a change in the amount of light reaching the detector when an article to be counted passes through the light beam provided by the light source. The light beams and detectors are operated alternately, so that light from one light source does not impinge on or influence the output of the detector that is opposite to the other light source. The resulting individual output signals from each light detector are combined to provide an equivalent article volume representative of the calculated volume of the article, which is compared with a predetermined article volume to determine whether the article should be counted.

BRIEF DESCRIPTION OF THE DRAWINGS

FIG. 12 is a flow chart showing the several steps in a run cycle for use in a system in accordance with the present invention.

FIG. 15 is a flow chart showing the several steps in a serial and video interrupt subroutine for use in a system in accordance with the present invention.

DESCRIPTION OF THE PREFERRED EMBODIMENTS

Figure 1:
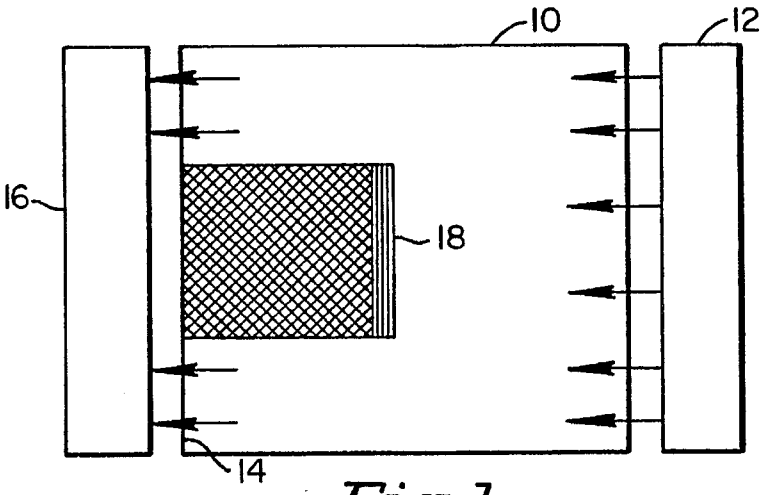
Fig. 1 PRIOR ART
FIG. 1 is an elevational view through an article-containing passageway of a prior art article sensing device including a single light source defining a sensing plane and a single light detector to detect an interruption of the light beam by an article within the passageway.

Referring now to the drawings, and particularly to FIGS. 1 through 4 thereof, there is shown a prior art article sensing station including a sensing plane 10 shown in exaggerated thickness form and defined substantially by an elongated light beam that emanates from an elongated light source 12. The light beam is so oriented as to pass perpendicularly across an article passageway 14 and to substantially completely sweep across the passageway to impinge upon the surface of an elongated light detector 16 positioned on the opposite side of the passageway from light source 12. Light detector 16 can be, for example, a solar cell.

Figure 2:
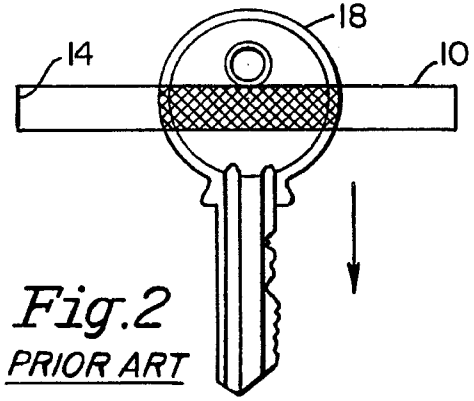
Fig. 2 PRIOR ART
FIG. 2 is a side view looking across the passageway and in the direction of the sensing plane of FIG. 1.
Figure 3:
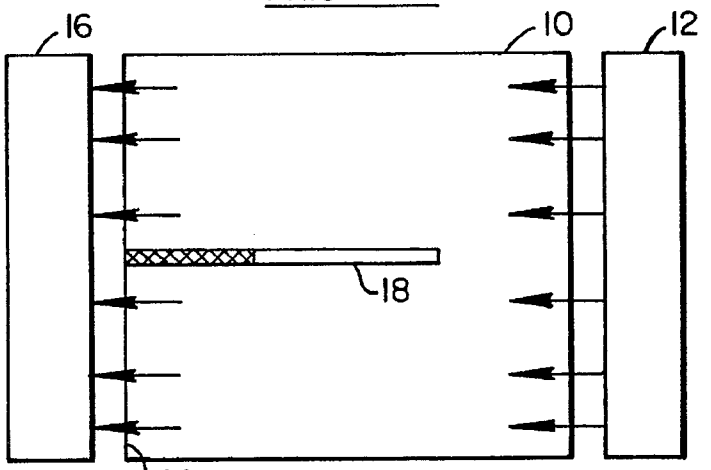
Fig. 3 PRIOR ART
FIG. 3 is an elevational view similar to FIG. 1, but showing the article to be sensed in a different orientation relative to the light source and light detector.
Figure 4:
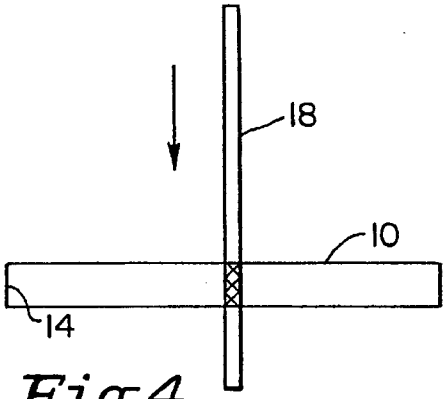
Fig. 4 PRIOR ART
FIG. 4 is a side view similar to FIG. 2, but with the article oriented as shown in FIG. 3.

An article 18, shown in the drawings for purposes of illustration in the form of a key for opening a lock, passes along passageway 14 in the direction shown by the arrows in FIGS. 2 and 4 as oriented relative to the light source and detector so that only the thickness dimension of the key is aligned with the direction of the light beam. As article 18 travels along passageway 14 it passes through sensing plane 10 to partially interrupt the light beam emanating from light source 12, and that interruption affects the amount of light impinging on detector 16 to thereby affect the strength of the output signal from detector 16. In the prior art device as shown in FIGS. 1 through 4, only a single light source 12 and a single light detector 16 are provided.

As will be appreciated, for irregularly-shaped articles that pass through sensing plane 10 and that interrupt the light beam passing across sensing plane 10 from light source 12 to light detector 16, the magnitude of the output signal from detector 16 is dependent upon the orientation relative to the light beam of the article that is to be sensed. Thus, a substantially flat article, such as key 18, blocks only a small quantity of light from light source 12 when the key is oriented so that its thickness dimension is perpendicular to the direction of the light beam, as shown in FIGS. 1 and 2, as compared with its orientation as shown in FIGS. 3 and 4, in which its thickness dimension is parallel with the direction of the light beam.

Figure 5:
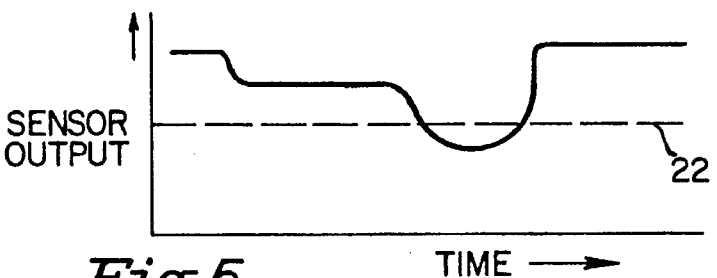
Fig.5 PRIOR ART
FIG. 5 is a graph showing light sensor output as a function of time as the article oriented relative to the light source as illustrated in FIGS. 1 and 2 passes through the sensing plane.

When article 18 is oriented as shown in FIGS. 1 and 2, the output from sensor 16 as a function of time is a signal of varying magnitude as shown in FIG. 5, corresponding with the variation of the cross-sectional area of the key, and the quantity of light blocked by the key as it passes through the sensing plane when oriented to present its broadest face across the light path. On the other hand, when the key is oriented relative to the light source in the position as shown in FIGS. 3 and 4, the output from sensor 16 as a function of time is a substantially lower magnitude signal, as shown in FIG. 6, corresponding with the constant width of the key.

Figure 6:
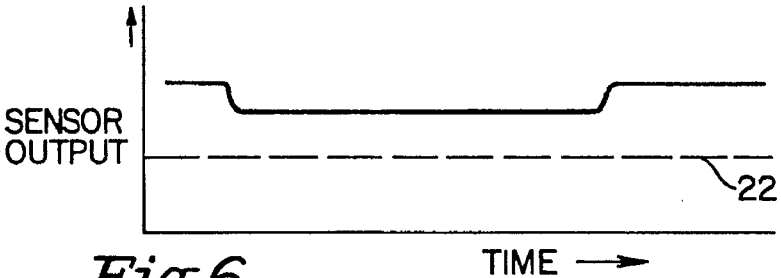
Fig.6 PRIOR ART
FIG. 6 is a graph similar to FIG. 5 but showing light sensor output as a function of time as the article oriented as illustrated in FIGS. 3 and 4 passes through the sensing plane.

Single light source sensing systems of the type shown in FIGS. 1 through 4 are usually set up to respond to and provide a count signal when the sensor output is below a predetermined base value, such as level 22 as shown in FIG. 6. Therefore, unless the article is properly oriented, such as the orientation shown in FIGS. 1 and 2, it could possibly not be counted, as might be the case for the article orientation shown in FIGS. 3 and 4. An example of a system that utilizes such a threshold value as a determinant in making a count is disclosed in U.S. Pat. No. 4,982,412, which issued Jan. 1, 1991, to Barry M. Gross. In that patent the sensing system also is arranged to provide pulses indicative of the end points of an article, and is also arranged to ignore pulses having a predetermined time length, in order to avoid double counting of a part. However, in that patent the articles to be counted are symmetrical about a longitudinal axis, and therefore their orientation is not critical.

In distinct contrast with the prior art devices, the present invention permits the accurate counting of irregularly-shaped articles regardless of their orientation within the sensing plane. In that regard the present invention includes a pair of crossed light beams with associated detectors, as shown in FIG. 7. A first radiant energy source 30 is disposed to emit an elongated first radiant energy beam to extend across a sensing plane 32 in a first direction. First radiant energy source 30 is positioned to cause the first beam to impinge upon and to be received by a first radiant energy detector 34 that is positioned directly across sensing plane 32 from first radiant energy source 30.

A second radiant energy source 36 is disposed at substantially a 90° angle to first radiant energy source 30 to emit a second elongated radiant energy beam to extend across sensing plane 32 in a direction perpendicular to the direction of the first beam. Second radiant energy source 36 is positioned to cause the second beam to impinge upon and to be received by a second radiant energy detector 38. Thus, two crossing radiant energy beams are provided, with the orientation of the sources 30 and 36 being such that the beam emanating from one source preferably does not impinge on the detector associated with the other source.

Figure 8:
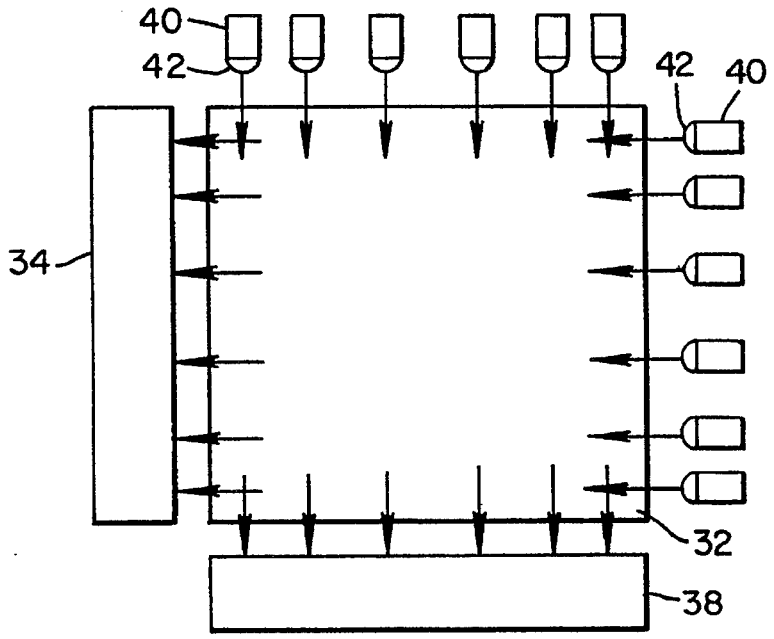
FIG. 8 is a view similar to FIG. 7, showing a series of light emitting diodes as the light sources at the sensing plane.

The respective radiant energy sources can be any of a variety of types, such as a series of light-emitting diodes 40, as shown in FIG. 8, or alternatively, they can be neon tubes, fluorescent tubes, or stroboscopic gas discharge devices, among others that are familiar to those skilled in the art. Hereinafter the beams will be referred to as light beams, although it should be understood that radiant energy sources other than those providing visible light can also be selected to be the sources of the radiant energy beams. Additionally, although referred to herein for convenience as a sensing plane, it will be appreciated that because the light beams emanating from the respective light sources have a finite thickness in the direction of movement of the articles to be sensed, strictly speaking sensing plane 32 is not a plane of infinitesimal thickness, but is, instead, a prism in the form of a rectangular parallelepiped.

Figure 9:
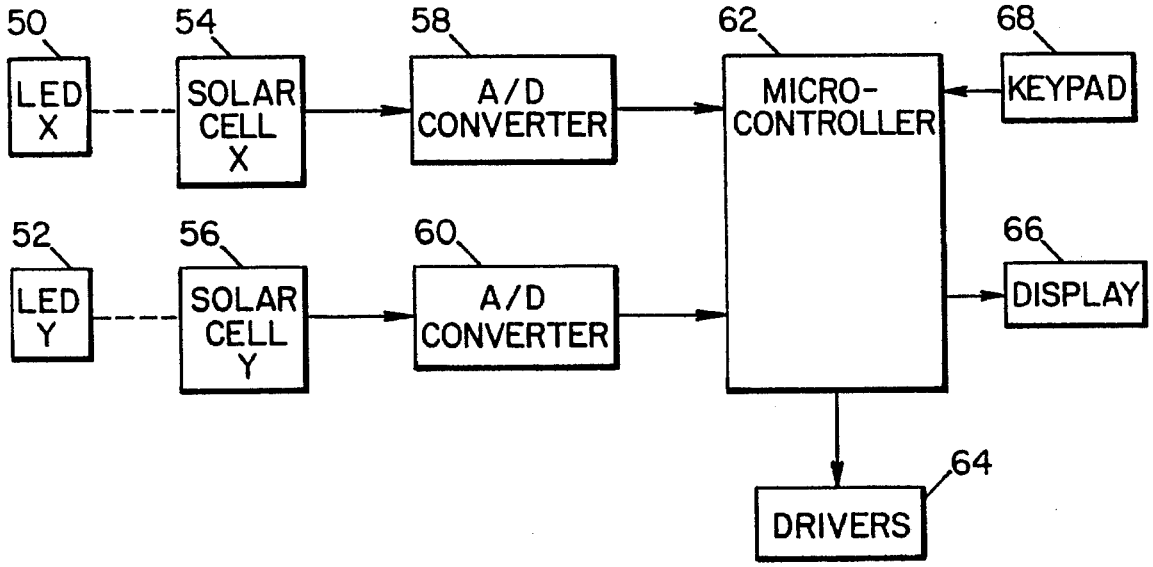
FIG. 9 is a block diagram showing the several elements of the system for controlling the apparatus and for performing the counting function in accordance with the present invention.

The structural arrangement shown in FIG. 8 can be employed as part of an article sensing and counting system in accordance with the block diagram shown in FIG. 9. A first aligned array 50 of individual LED's 40 as shown in FIG. 8 is positioned along one side of the article sensing plane, and a second aligned array 52 of individual LED's 40 is positioned substantially at right angles to first array 50, again as illustrated in FIG. 8.

The light detectors are provided in the form of a pair of solar cells, a first solar cell 54 positioned opposite first array 50 of LED's and a second solar cell 56 positioned opposite second array 52 of LED's. Each of LED arrays 50 and 52 can be provided by a total of ten LED's, as shown in FIG. 8, preferably with lenses 42 on each LED to focus the light beams emanating from the respective LED's into narrow cones.

Preferably, the LED arrays are switched so that when array 50 is on, array 52 is off, and vice versa. And when LED array 50 is in the ON condition solar cell 54 is also switched on, and when LED array 50 is in the OFF condition solar cell 54 is also switched off. Similarly, when LED array 52 is in the ON condition solar cell 56 is also switched on, and when LED array 52 is in the OFF condition solar cell 56 is also switched off. Thus, the method and apparatus in accordance with the present invention operate to prevent light from one light source from influencing the output of the detector associated with the other light source.

Figure 7A:
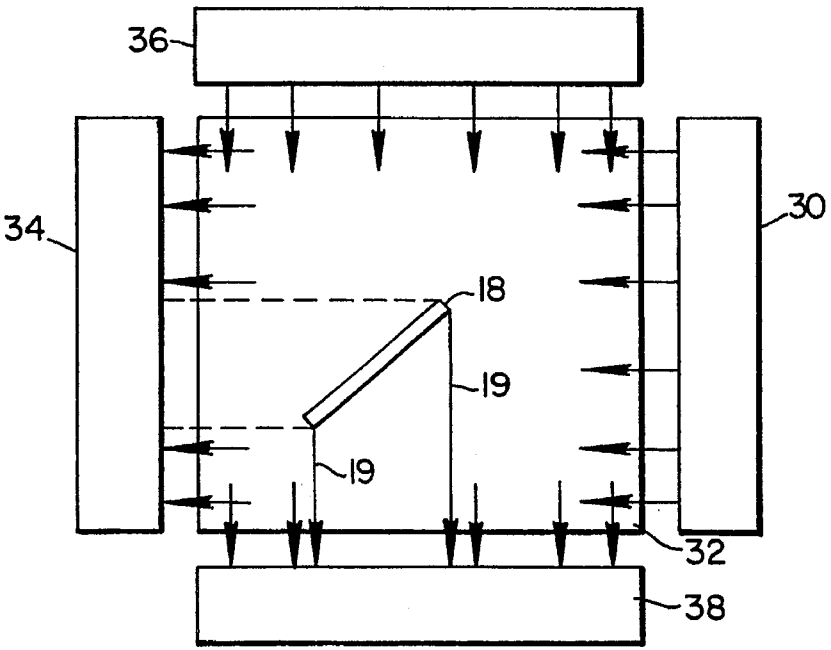
FIG. 7A is an elevational view similar to FIG. 7 showing an article as it passes through the sensing plane of apparatus in accordance with the present invention, the article being shown as having been rotated, relative to the directions of the respective light beams, to a position between those positions of the article that are illustrated in FIGS. 1 and 3.
Figure 7:
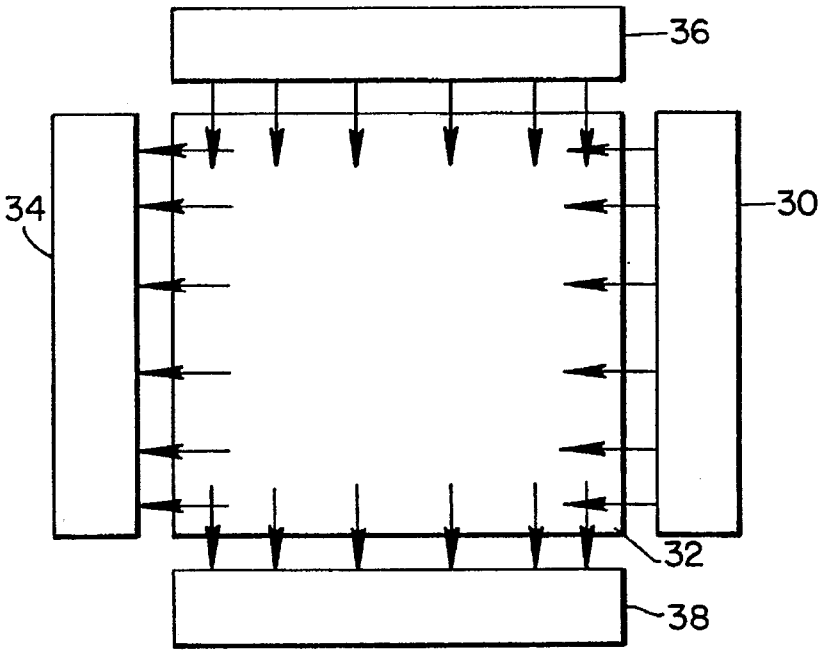
FIG. 7 is an elevational view similar to FIG. 1, but taken at an article sensing plane utilizing a dual light source an dual light sensor arrangement in accordance with the present invention.

When the article to be counted, key 18 as shown in the drawings, is so oriented, as shown in FIG. 7A, that a portion of the light from source 30 is partially reflected onto detector 38, represented by beams 19, if both detectors were operative at the same time it would be possible for detector 34 to provide an output signal indicative of the presence of an article, while detector 38 could provide an output signal indicative of the absence of an article, because of the additive effect of the reflected light beams 19. The present invention avoids that confusing result and prevents the reflected portion of the beam from having an effect on the output of detector 38, because in the present invention only one source and its associated one detector are operative at any one time.

Referring to FIG. 9, in the present invention, as an article passes through the plane of light defined by the respective light sources 50, 52 during their operative periods, the amount of light impinging on the respective associated solar cells 54, 56 is diminished in an amount that is dependent upon the projected area of the article on the surface of the solar cell. That projected area is a function of the size of the portion of the article that is opposite to the light source and the orientation of the article relative to the solar cell as the article passes through the sensing plane of light defined by the light source. That diminution of light caused by the article results in a reduced solar cell output value, which is in the form of an analog signal. The individual analog signals emitted by the respective solar cells 54, 56 are conditioned in an analog to digital converter 58, 60, to provide digitized output signals representing the amplitude variations of each of the two solar cells.

A microcontroller 62, or its equivalent, is programmed to receive and to analyze the digitized output signals by effectively integrating the digitized amplitude values as a function of time. Advantageously, the microcontroller, which can be, for example, an Intel 8051 or 8751 microcontroller, is programmed to ignore short duration dropouts, such as electrical noise, reflections, or the like.

Microcontroller 62 is also programmed to sequence the events related to the counting and the batching of the articles, through drivers 64, that can control the operation of auxiliary devices, such as the operation of an article feeder device (not shown), which can be a vibratory, rotating feeder bowl, the structure and operation of which are well known to those skilled in the art. Additionally, a plurality of drivers 64 can also be connected with microcontroller 62 to provide output signals that control solenoids that operate an accumulator gate (not shown) to hold counted articles and release them on demand, and a deflector gate (not shown) for deflecting articles in excess of the required count. Further, AC triac drivers can be connected with the system to operate horizontal and vertical vibratory elements associated with the feeder bowl, to provide either or both horizontal and vertical vibrations to the bowl, as well as a feed hopper driver. Again, the structure and operation of such accumulator and deflector gates in connection with prior art vibratory and non-vibratory feeder bowls are well known to those skilled in the art and are therefore not further described herein.

Microcontroller 62 can also provide output signals to operate a display device 66, which can be an alphanumeric display showing size parameters of an article, the number of articles counted, and the like. Additionally, microcontroller 62 can provide signals to operate light emitting diodes to indicate the status of the device to an operator. Optionally, microcontroller 62 can also be programmed to control the operation of an operator interface that can be connected with other counting and filling systems, and to enable real-time serial communications with a host computer, if desired.

In addition to display 66, a keypad 68 can also be connected to microcontroller 62 to provide input signals to control operation of the system. The keypad can be of the membrane type and is treated by the microcontroller as read-only memory.

Power supplies suitable for use with the system described herein can include a logic power supply in the form of a regulated, 5 volt DC supply for TTL logic, and an analog power supply in the form of a regulated, 12 volt DC supply to the analog elements of the system. Additionally, an unregulated 24 volt DC power supply can be provided to operate gate solenoids that control the operation of the deflector and accumulator gates.

Interface convertors can include a demand interface convertor including an opto-isolator sourcing 12 volts through an approximately 1k ohm resistor to detect sinking demand input, to signal the start of an operating cycle. A busy-in interface convertor can include an opto-isolator sourcing 12 volts through an approximately 1k ohm resistor to detect busy status of outside devices sinking to ground. A busy-out interface convertor can include an opto-isolator sinking to ground on a busy line to signal local busy status to other devices in the system. Further, a system advance relay, in the form of a hard contact relay to ground, can be provided to signal product dump to the system, and to allow isolation of control signals.

In the operation of the present invention, an operational amplifier is provided, as a first amplifier stage, and operates in the inverting, zero impedance input mode to receive the solar cell output signals and to provide a current to voltage conversion of those signals. The gain of the first amplifier stage is fixed and is set by a feedback resistor. One or more gain stages can be provided to set the solar cell voltage output at the maximum ambient light level, which is the light level when nothing is in the path of the light from the light source to the associated solar cell, to be equal to a fixed reference voltage level of an analog to digital convertor by the use of a digital to analog convertor under software control.

In a preferred embodiment, the microcontroller provides a digital value to a digital to analog converter of the R2R ladder type, operating as a digitally controlled potentiometer, to set the variable gain of a second stage operational amplifier. The maximum output of the second stage amplifier, representing the ambient current value of the unobscured solar cell, is controlled and is set on a regular basis by the program logic to equal the fixed reference voltage of an eight bit analog to digital converter.

In another embodiment, the variable gain stage is eliminated, and the analog to digital converter is supplied by the digital to analog converter with a voltage reference signal equal to the unobscured ambient value of solar cell output. The effect is that the value of the digital signal present at the output of the analog to digital converter will be full scale (all bits set to 1, equivalent to 255 decimal) when the solar cell is in the unobscured condition.

Upon conversion of the analog value of the solar cell output to a digital value, and to facilitate calculations, the microcontroller logic complements the digital signal value internally. As a result, signals representative of light values that are less than the maximum ambient light condition, which represents the condition when an article passes through the light plane, are actually treated as increasing values of light drop, effectively as a percentage of the amount of light that is obscured.

During the period of time that a signal from a solar cell exceeds a minimum threshold level, that signal is added to an accumulator register each time the respective light sources are operative. There is one accumulator register for the X view and another, similar, register for the Y view. A third register accumulates the number of signals accumulated, after it is determined that a signal should be counted. When the article completes its passage through the light plane, the quantity of light drop no longer exceeds the threshold.

After the article has completed its passage through the light plane, the light drop values that were accumulated during the scan for each view (hereafter referred to as the X view and the Y view) are added together to provide a total light drop value for each view. The resulting total light drop values for each view are each divided by the number of times the light beams were operative for each of the X and Y views (the number of signals) in which the article was seen (hereafter referred to as the Z view) to determine the average light drop value for that view for the entire scan of the article.

In the preferred embodiment, logarithms of each of the X view average and the Y view average and the Z view values are derived from a look-up table within the microcontroller. Those logarithms are added together, divided by three to provide a resulting value, and the antilog of that resulting value is determined from another look-up table within the microcontroller. The resulting antilog is a value representing one dimension of a cube having a volume approximating that of the article that was scanned. That calculated antilog value is then compared with a predetermined value for the particular article intended to be counted, and if that antilog value corresponds with the predetermined value the article accumulator register is incremented.

Figure 10A:
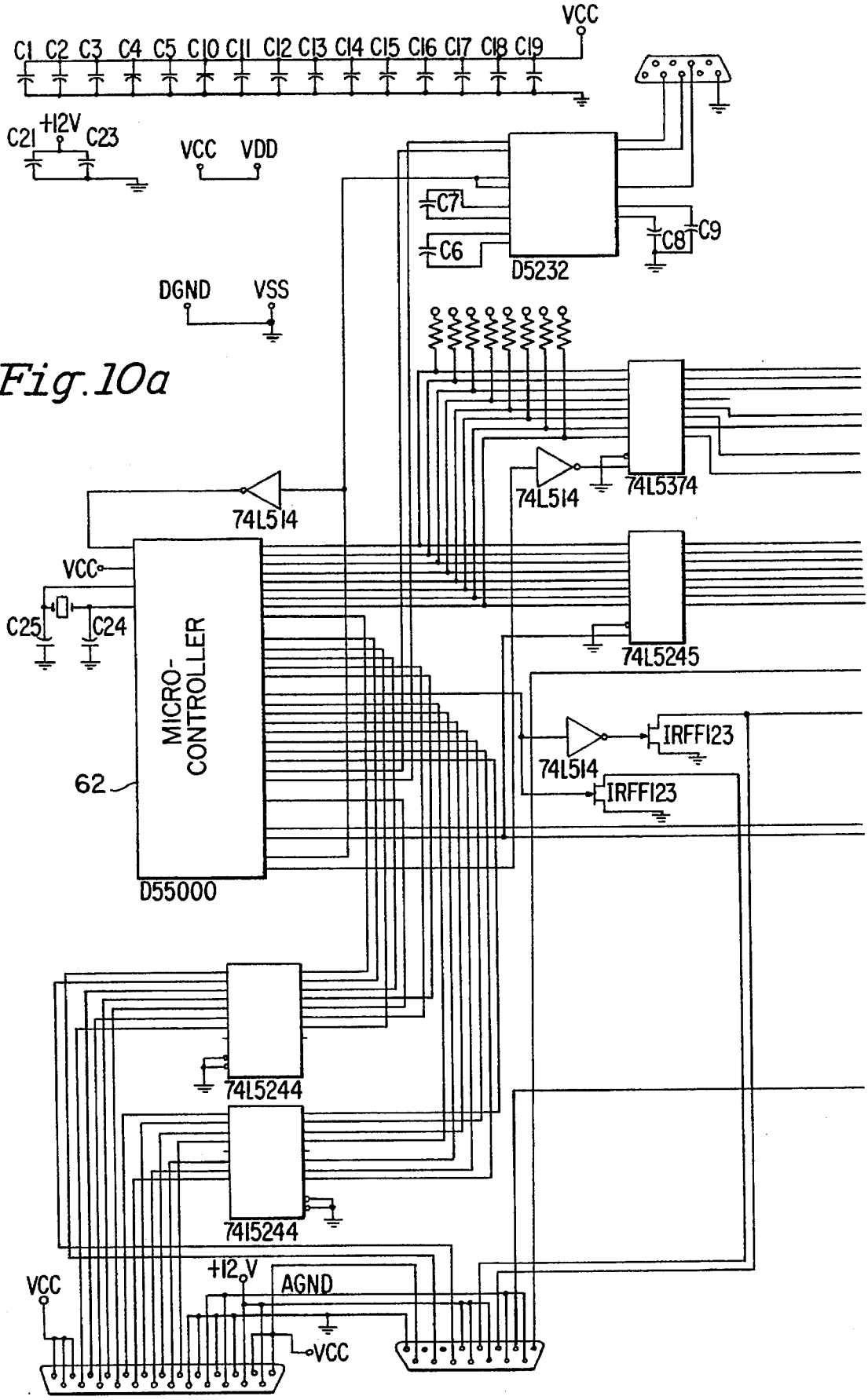
FIG. 10 is a circuit diagram for one embodiment of the digital logic elements of the present invention.
Figure 10B:
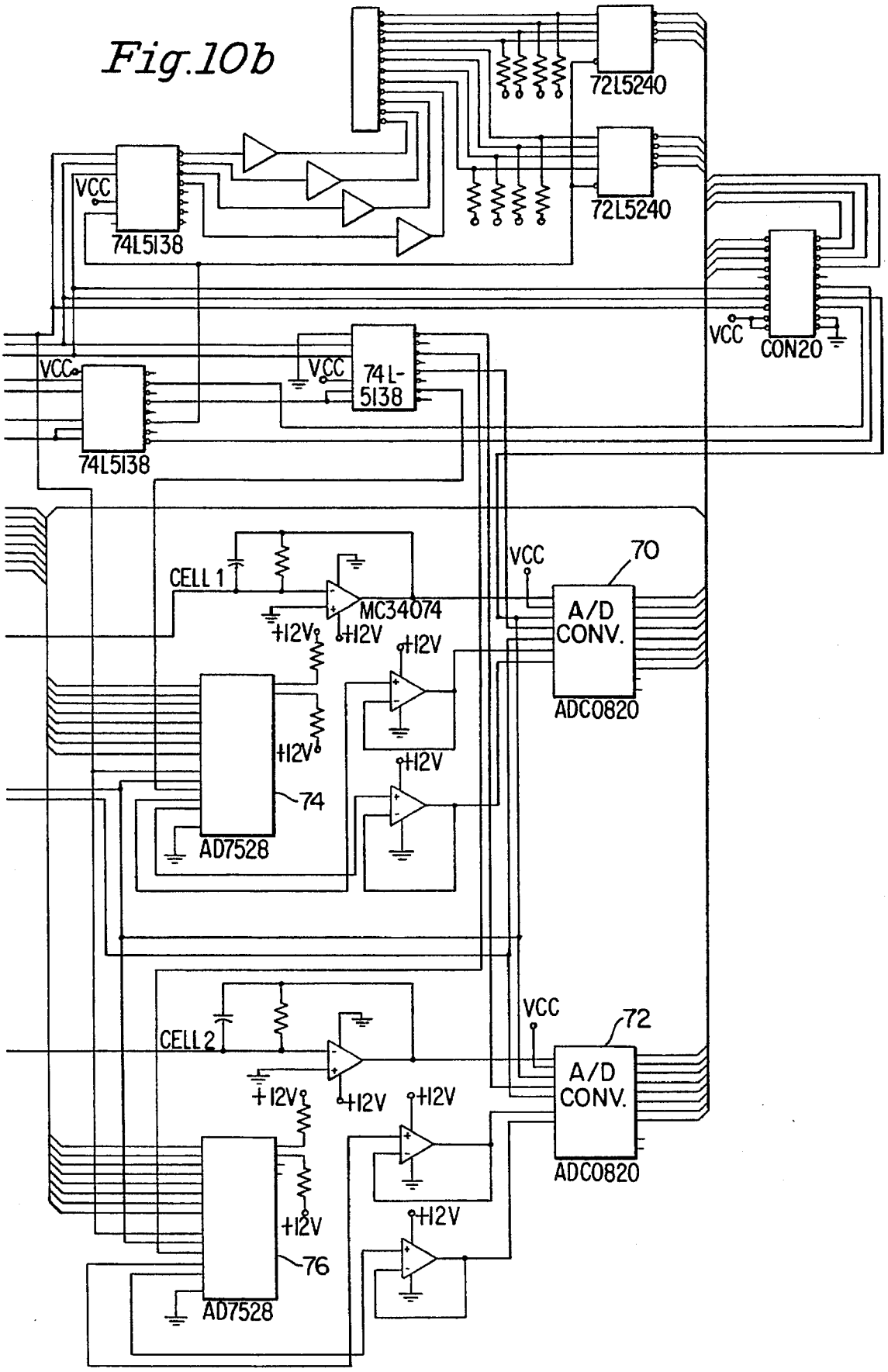

FIG. 10 shows a circuit diagram for a logic circuit containing circuit elements that are arranged to carry out the method steps forming part of the present invention. The principal components of the logic circuit shown in FIG. 10 include microcontroller 62, analog to digital convertor 70 for cell 1, or the X view solar cell, analog to digital convertor 72 for cell 2, or the Y view solar cell, digital to analog convertor 74 for the X view solar cell, and digital to analog convertor 76 for the Y view solar cell.

Figure 11:
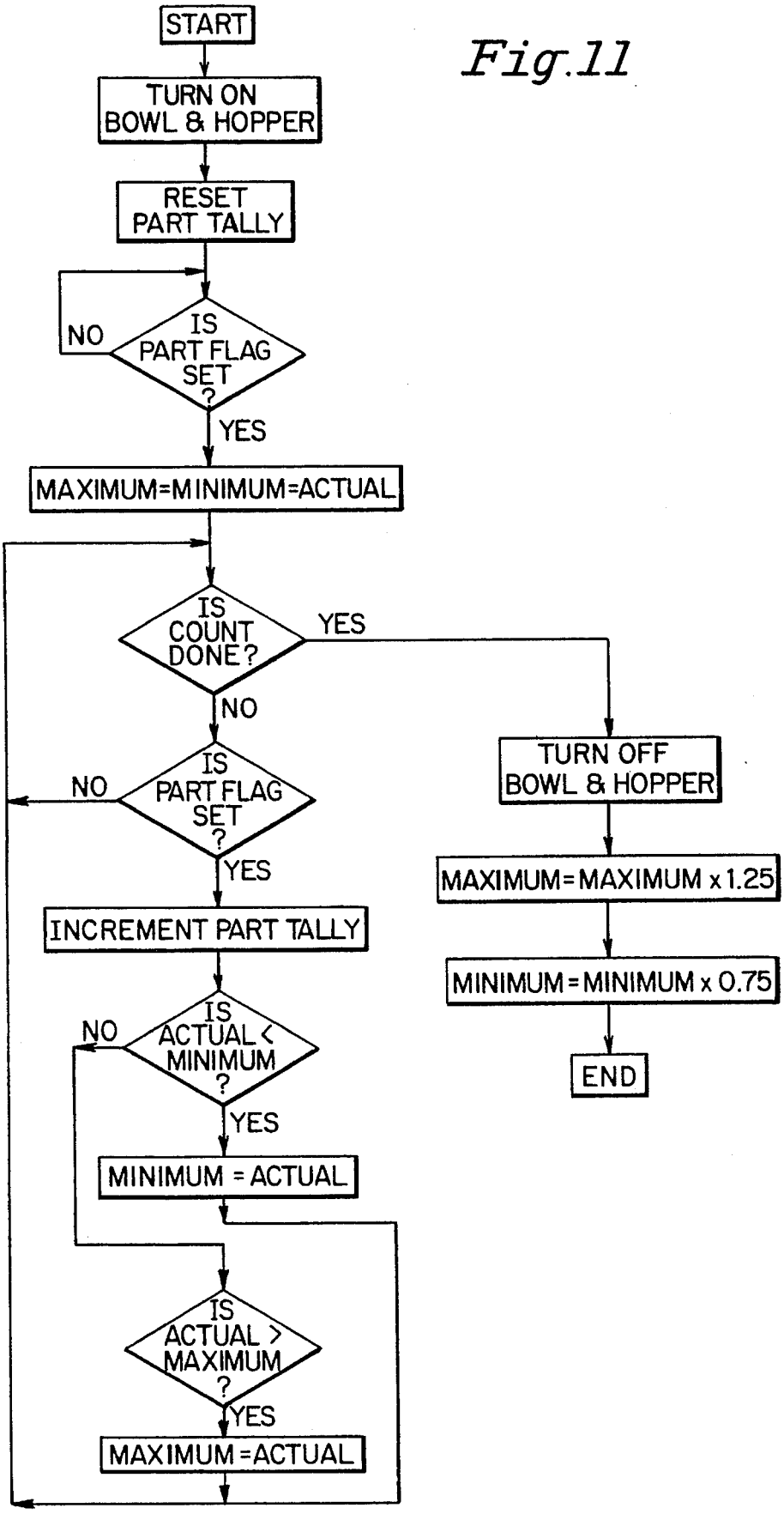
FIG. 11 is a flow chart showing the steps of an autoconfiguration subroutine for use in the present invention.

FIGS. 11 through 14 are flow charts that show the steps involved in several subroutines for use in the present invention. FIG. 11 shows an autoconfiguration subroutine for setting the initial parameters that govern the later determinations of whether a sensed article should be counted. In the preferred form of operation of the invention, initially articles are individually passed through the sensing plane, and the first ten articles are sensed to establish a low/high range. The next twenty-five articles are then counted and the solar cell output values for the smallest size part and for the largest size part are determined. The counting limits are then set to define a maximum size limit of 5/4 of the solar cell output that was measured for the largest size article as previously determined, and a minimum size limit of 3/4 of the solar cell output of the smallest size article as previously determined.

FIG. 12 shows the several steps in one form of run cycle in accordance with the present invention. In that connection, when an article is not seen during at least 8 XY scans, the article bit is set and the article profile is calculated as follows:

if low range:

$$\text{value} = \text{antilog}\,\frac{(X \cdot \log \text{total}/Z) + (Y \cdot \log \text{total}/Z) + \log Z)}{3}$$

else:

$$\text{value} = \text{anitlog}\,\frac{(X \cdot \log \text{total}/Z) + (Y \cdot \log \text{total}/Z) + \log Z) * 2}{3}$$

Figure 13:
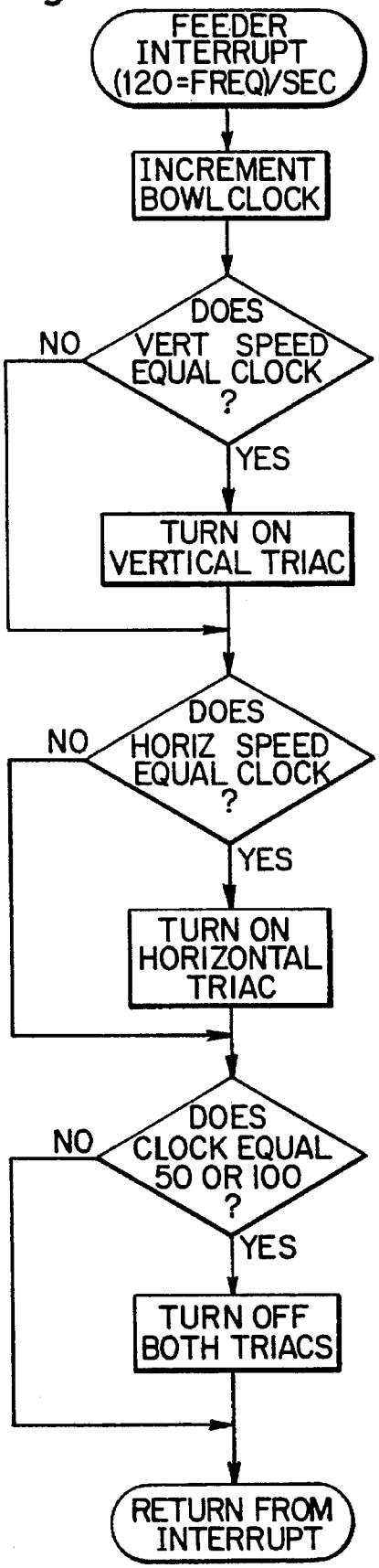
FIG. 13 is a flow chart showing the several steps in a feeder interrupt subroutine for use in a system in accordance with the present invention.

FIG. 13 shows a flow chart for the feeder interrupt. This subroutine operates to increment the feeder bowl clock 120 times per AC cycle, and compares the bowl clock accumulator to horizontal and vertical speed presets. It turns on the triac of each phase when it is equal to the preset, and it turns off the triacs prior to the next positive going or next negative going zero-crossing.

Figure 14:
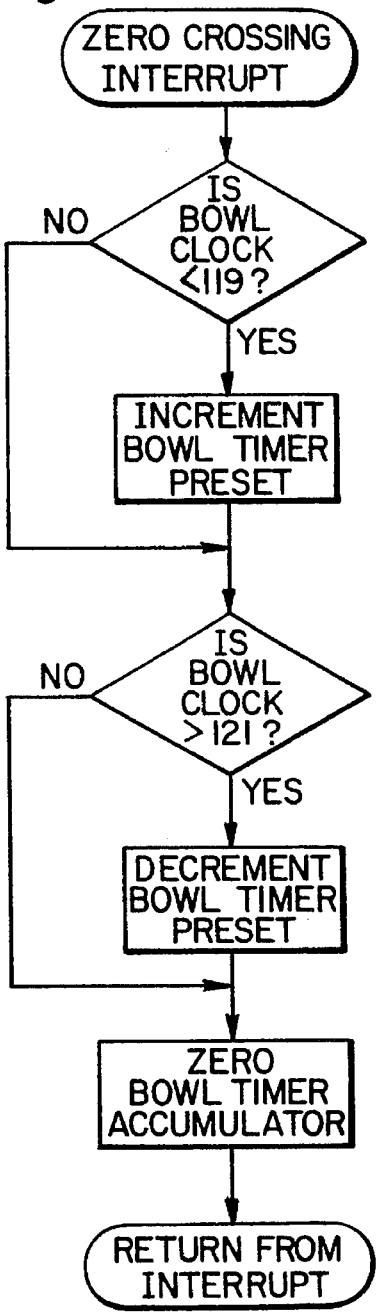
FIG. 14 is a flow chart showing the several steps in a zero crossing interrupt subroutine for use in a system in accordance with the present invention.

FIG. 14 shows a flow chart for the zero crossing interrupt. Upon negative-to-positive transition of AC line voltage, this interrupt checks the accumulator value of the feeder bowl clock. If the value is less than or equal to 119, then the timer is speeded up; if the value is greater than or equal to 121, the timer is slowed down, effectively automatically tracking line frequency. This allows use of this feeder system in foreign countries, or in areas in which poor line frequency control is maintained. The feeder bowl clock preset is then set to zero to begin a new cycle.

FIG. 15 is a flow chart for the serial and video interrupt, which performs the bulk of the work during operation of the system. The interrupt is driven by the end of transmission of a serial data byte, or the receipt of a serial data byte, and the rate of 19,200 baud. Transmit interrupts are kept active when no data are being sent by sending "dummy" bits with port disabled but interrupts still active. If the interrupt was caused by a receive byte, only serial communications are serviced. If a transmit interrupt causes it, then alternately X and Y views are examined, light levels are accumulated, and system timers are incremented. Additionally, periodic calibration is performed.

The present invention permits the accurate detection and counting of irregularly or unsymmetrically shaped articles, such as articles in the form of the key blanks shown in FIGS. 1 through 4. When a key blank is edge-on to one light beam it is broadside to the other light beam, and vice versa, and the combination of the individual signals from the respective solar cells allows the count to be accurate, thereby reducing the loss from failing to count all articles.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within scope of the present invention.

What is claimed is:

1. A method for detecting and counting articles that travel along a passageway, said method comprising:

a. passing articles past a pair of orthogonally positioned light sources and respective orthogonally positioned light detectors at a detection station;

b. operating the light sources alternately as the articles pass through the detection station;

c. sensing the quantity of light that is detected by each light detector as each light source is operated and providing electrical signals representative of the amounts of light received by the respective light detectors;

d. storing the respective electrical signals and the times corresponding with each signal;

e. calculating average light drop values over the total time the articles have been within the detection station to provide an equivalent volume of the sensed article; and f. comparing the equivalent volume with a predetermined volume to decide whether the article should be counted.

2. A method in accordance with claim 1, including the step of interposing a deflector in the path of the articles to deflect additional articles after a desired number of articles has been counted.

3. A method in accordance with claim 1, wherein the articles to be detected and counted are unsymmetrical about at least one axis.

4. A method for detecting and counting articles that travel along a passageway, for subsequent packaging of a desired number of such articles, said method comprising:

a. passing the articles across a sensing plane of light defined by pair of orthogonally positioned light sources and respective orthogonally positioned light detectors at a detection station;

b. operating the light sources alternately as the articles pass through the detection station to provide alternate, orthogonally oriented light beams at the detection station;

c. sensing the quantity of light that is detected by each light detector as each light source is operated while articles pass the detection station and providing a series of electrical signals representative of the amounts of light received by each of the respective light detectors over a sensing period;

d. integrating as a function of time the series of electric signals provided by the respective light detectors to provide integrated light values representative of each sensing direction;

e. adding the integrated light values together;

f. comparing the resulting sum of the integrated values with a predetermined range of acceptable light values based upon articles of the type to be counted that had been previously passed through the sensing plane to determine an acceptable range; and g. counting the article when the comparison of light values falls within the acceptable range.

5. A method for detecting and counting articles that travel along a passageway, for subsequent packaging of a desired number of such articles, said method comprising:

a. passing the articles across a sensing plane of light defined by pair of orthogonally positioned light sources and respective orthogonally positioned light detectors at a detection station;

b. operating the light sources alternately as the articles pass through the detection station to provide alternate, orthogonally oriented light beams at the detection station;

c. sensing the quantity of light that is detected by each light detector as each light source is operated while articles pass the detection station and providing a series of electrical signals representative of the amounts of light received by each of the respective light detectors over a sensing period;

d. storing the respective electrical signals and the times corresponding with each signal;

e. adding together individual light values sensed by each detector over a sensing interval;

f. calculating average light values over the total time an article has been within the detection station for light signals from each light detector;

g. determining logarithmic values for each average light value and for the number of times the respective light beams were operative during a sensing cycle and adding the logarithmic values together to provide a logarithmic sum;

h. dividing the logarithmic sum by three to provide a resulting value; and i. determining the antilogarithm of the resulting value and comparing that antilogarithm with a predetermined value to assess whether the signals represent an article to be counted.

6. A method in accordance with claim 5, including the following steps prior to commencing an article counting operation:

a. passing through the sensing plane a selected first number of articles to be counted to establish a range of light output values from high to low for acceptable articles;

b. passing through the sensing plane a second number of articles to be counted to establish the volume of a smallest and a largest acceptable article; and c. setting a counting limit based upon a first predetermined multiplier of the volume of the largest volume acceptable part and a second predetermined multiplier of the volume of the smallest volume acceptable part.

7. A method in accordance with claim 6, wherein the first multiplier is about 1.25 and the second multiplier is about 0.75.

8. A method in accordance with claim 5, including the steps off a. incrementing an article accumulator register when an article to be counted is sensed; and b. operating an article deflector to divert articles after a predetermined number of articles has been counted.

* * * * *